US007224330B2

(12) United States Patent
Rilly et al.

(10) Patent No.: US 7,224,330 B2
(45) Date of Patent: May 29, 2007

(54) METHOD OF CONNECTING A PLASMA PANEL TO THE ELECTRICAL POWER SUPPLY THEREFOR IN AN IMAGE DISPLAY DEVICE

(75) Inventors: Gérard Rilly, St Etienne Crossey (FR); Gérard Morizot, Voiron (FR); Jean-Raphaël Bezal, Meylan (FR)

(73) Assignee: Thomson Licensing, Boulogne-Billancourt (FR)

( * ) Notice: Subject to any disclaimer, the term of this patent is extended or adjusted under 35 U.S.C. 154(b) by 320 days.

(21) Appl. No.: 10/481,725

(22) PCT Filed: Jun. 14, 2002

(86) PCT No.: PCT/FR02/02043

§ 371 (c)(1),
(2), (4) Date: Dec. 22, 2003

(87) PCT Pub. No.: WO03/003400
PCT Pub. Date: Jan. 9, 2003

(65) Prior Publication Data

US 2004/0169472 A1 Sep. 2, 2004

(30) Foreign Application Priority Data

Jun. 29, 2001 (FR) ..... 01 08626

(51) Int. Cl.
*G09G 3/28* (2006.01)

(52) U.S. Cl. ..... 345/60; 345/66

(58) Field of Classification Search ..... 345/60–72; 313/582, 583, 584, 631; 315/169.1, 169.4, 315/169.2, 169.3; 348/797
See application file for complete search history.

(56) References Cited

U.S. PATENT DOCUMENTS

| | | | | |
|---|---|---|---|---|
| 6,118,214 | A * | 9/2000 | Marcotte | 313/582 |
| 6,662,793 | B1 * | 12/2003 | Allen et al. | 123/620 |
| 2002/0043621 | A1 * | 4/2002 | Aitken | 250/281 |
| 2005/0029958 | A1 * | 2/2005 | Morizot et al. | 315/160 |

FOREIGN PATENT DOCUMENTS

| | | | |
|---|---|---|---|
| EP | 3326182 | * | 7/1983 |
| EP | 1065694 | | 1/2001 |

OTHER PUBLICATIONS

Patent Abstracts of Japan, vol. 1999, No. 05, May 31, 1999 & JP 11-041545.
Patent Abstracts of Japan, vol. 2000, No. 08, Oct. 6, 2000 & JP 2000-133140.
Search report dated Oct. 18, 2002.

* cited by examiner

*Primary Examiner*—Nitin Patel
(74) *Attorney, Agent, or Firm*—Joseph J. Laks; Harvey D. Fried; Patricia Verlangieri

(57) ABSTRACT

The invention relates to a device comprising a metallic support plate, the front face of which supports a plasma discharge panel which is equipped with a network of pairs of adjacent electrodes and the rear face of which is equipped with a power supply. According to the invention, the connection ends of the electrodes of one electrode pair are located on opposite edges of the panel and the power circuit of each pair of adjacent electrodes forms a current loop that does not surround the metallic plate. In this way, electric losses are restricted in said plate and the cells of the panel operate identically along the entire length of the electrodes.

9 Claims, 2 Drawing Sheets

Figure 4:
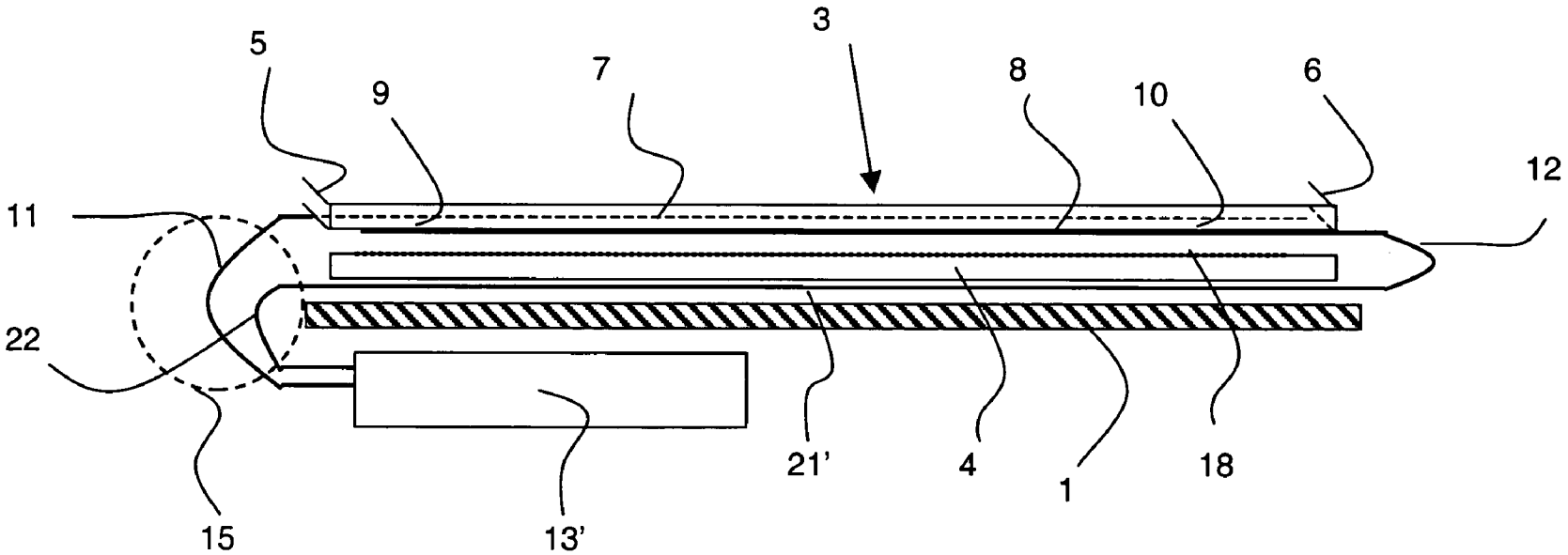

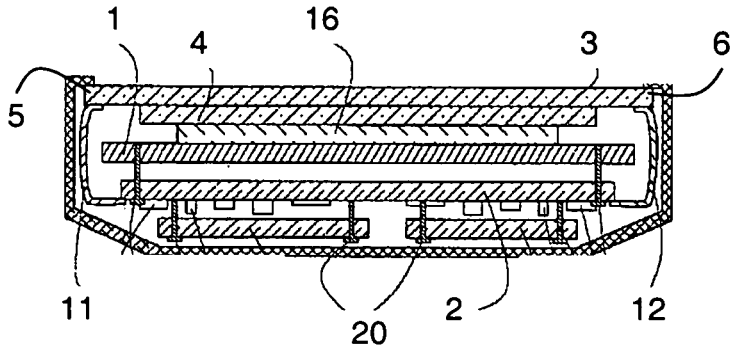
Fig.1 – PRIOR ART
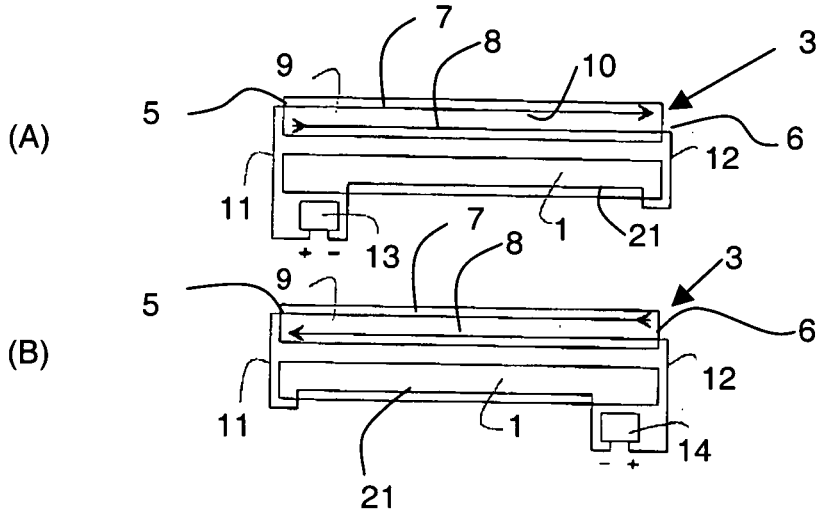
Fig.2 – PRIOR ART
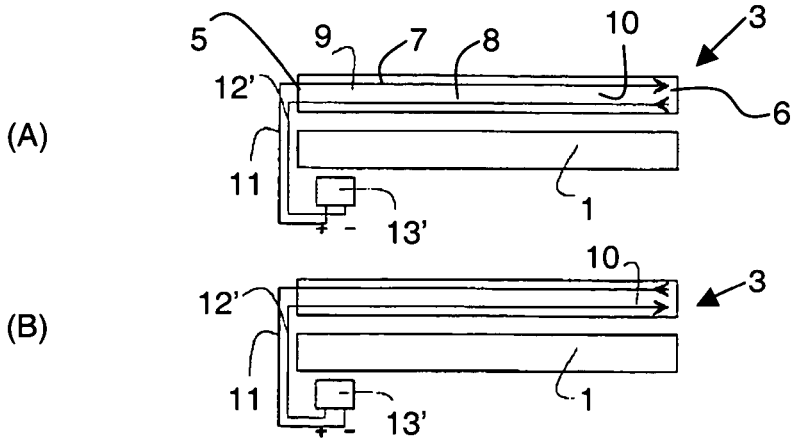
Fig.3 – PRIOR ART

METHOD OF CONNECTING A PLASMA PANEL TO THE ELECTRICAL POWER SUPPLY THEREFOR IN AN IMAGE DISPLAY DEVICE

This application claims the benefit, under 35 U.S.C. § 365 of International Application PCT/FR02/02043, filed Jun. 14, 2002, which was published in accordance with PCT Article 21(2) on Jan. 9, 2003 in French and which claims the benefit of French patent application No. 0108626, filed Jun. 29, 2001.

The invention relates to the connection of a plasma display panel to means for supplying and driving this panel.

Referring to FIGS. 1 and 2 appended hereto, document JP 2000-089723 (HITACHI) discloses an image display device, especially for television, comprising a metal support plate 1, generally made of aluminium, supporting, on one face, an AC plasma discharge panel and, on the other face, at least one printed-circuit board 2 supporting means 13, 14 for supplying and driving the discharges of the said panel.

The plasma panel itself comprises a front tile 3 and a rear tile 4, leaving between them plasma discharge regions, and is provided, between these tiles:

- with at least a first array of electrodes serving in particular for sustaining discharges by applying voltage pulses between adjacent electrodes 7, 8 of two series of different electrodes of this first array; and
- with a second array of electrodes for addressing the discharges (this second array not being shown), crossing the electrodes of the first array so as to form, at their intersections and between the tiles 3, 4, discharge spaces.

On the tile 3, the connection ends of the electrodes of one series are all located on an edge 5 opposite to that 6 on which all the connection ends of the electrodes of the other series are located.

The supply circuit for each pair of adjacent electrodes 7, 8 of two different series forms a current loop from the supply and drive means, passing via a first electrode 7 and then the second electrode 8 of the pair.

All these components are inserted into a box 20.

The rear tile 4 of the plasma panel is fastened to the metal support plate 1 by means of an adhesive layer 16 having a thickness sufficient to compensate for the difference in thermal expansion coefficient between the tile and the plate; the adhesive for this layer 1 is designed, in a manner known per se, to ensure heat transfer of the heat dissipated in the panel during operation into the plate 1 which, because it is made of metal, possesses a better coefficient for heat exchange with the air circulating in the box 20.

Document JP11-041545 (FUJITSU) also discloses an image display device of this type, in which the printed-circuit board 2, supporting the supply and drive means, specifically extends over the entire surface of the panel and is directly bonded to the support plate 1 so as to shorten the connections between the ends of the electrodes on the edges of the panel and the supply and drive means on either side of the support plate 1; no transverse conductor is inserted between the panel and the support plate.

Between adjacent electrodes 7, 8 of two different series of electrodes of this first array there is therefore a succession of sustain discharge regions, which generally correspond to a line of picture elements or pixels to be displayed; this array of electrodes may also serve for addressing in cooperation with the electrodes of the second array; thus, the electrodes of the first series may be sustain and addressing electrodes and the electrodes of the second series are then only sustain electrodes.

These electrodes of the first array are generally coplanar.

This sustain array generally comprises only two series of electrodes so that the adjacent electrodes 7, 8 of different series are grouped in pairs; according to other embodiments, the first array may comprise three series and the coplanar electrodes are then associated in triads.

As shown in FIGS. 1 to 3, the sustain electrodes 7, 8 of the first array are generally placed on the internal face of the front tile 3; according to an alternative embodiment, they may be placed on the internal face of the rear tile 4.

The means 13, 14 for supplying and driving the discharges generally comprise:

- power supply means suitable for generating series of pulses of high electrical voltage, generally greater than 100 V;
- drivers (for switching the various electrodes) designed to apply the said voltage pulses to the electrodes selected by the drive means.

As the first array of electrodes 7, 8 serves for sustaining the discharges, it is in this array that most of the electrical power needed for displaying the images is dissipated, and it is therefore in this array that significant electrical losses may occur.

FIGS. 1 and 2A show that the supply circuit for each pair of electrodes 7, 8 forms a current loop starting from the supply and drive means 13 and passing through a first conductor 11, going from one side of the support plate 1 to the other, a first electrode 7 and then, through the succession of discharge regions supplied by this pair, the second electrode 8 of the pair, a second conductor 12, going in the opposite direction from one side of the support plate 1 to the other, and a third conductor 21, going from one edge of the support plate 1 to the other, until returning to the supply and drive means 13.

FIGS. 1 and 2B show that the circuit for supplying each pair of electrodes 7, 8 also forms a current loop in the opposite direction, which in this case contains supply and drive means 14 positioned on the opposite side from the previous means 13 on the support plate 1.

During the discharge sustain steps when the device is in operation, discharges spring up between the electrodes of each pair 7, 8 and large currents flow in these loops.

The conventional method, shown schematically in FIG. 2, of connecting the electrodes of the panel located on one face of the support plate 1 to the supply means 13, 14 located on the other face has the following drawbacks:

- the current loop formed by the supply circuit for each pair of electrodes 7, 8 surrounds the metal support plate 1 and generates, in this plate, substantial losses by Eddy currents; when a current loop surrounds a metal plate, high induced currents appear on both faces of this plate, the direction of the current being reversed from one face to the other; the currents induced in this plate cause losses, and local overheating, and they disturb the electronic circuits placed nearby; and
- this method of connection preferably requires two different electrical power supplies 13, 14 positioned at opposed edges 5, 6 of the panel, making it relatively expensive.

The transverse conductor 21 passing from one edge of the support plate 1 to the opposite edge is located here on the same side of the support plate 1 as the supply and drive means 13, 14; according to an embodiment described in the document EP 1 065 694 (SAMSUNG), this transverse conductor may be located on the same internal face of the tile 3 that carries the electrodes, that is to say on the opposite side from the supply and drive means 13, 14 with respect to the support plate 1 (see conductor 12'*a* in FIG. 8 of that document); no transverse conductor is inserted between the panel and the support plate; as that document teaches, this transverse conductor must then be shifted away from the light emission region and positioned on average at a large distance from the pairs of electrodes; the current loops then have on average a vertical cross section of large area, generate an electromagnetic field having a large horizontal component and also induce electric currents in the metal support plate, thereby causing undesirable electrical losses and parasitic radiation.

It should be noted that, in these conventional methods of connecting a plasma panel to its supply means, the first conductor 11 and the second conductor 12, which both pass from one side of the support plate 1 to the other, are placed on opposed edges of the panel since the ends of the electrodes that they serve are on opposed edges.

To avoid the aforementioned drawbacks, the abovementioned document JP 2000-089723 discloses, with reference to FIG. 3 appended hereto, a circuit in which all the electrodes of the sustain array are supplied via their end at the same edge 5 of the plasma panel so that:

as shown in FIG. 3, the current loop formed by the supply circuit for each pair of electrodes 7, 8 no longer surrounds the metal plate 1; thus, the Eddy current losses in this plate are prevented; and a single electrical supply 13' may serve, without any drawback, for all the alternations of the sustain pulses, as shown in FIGS. 3A and 3B.

It should be pointed out that, according to this other connection and supply method for a plasma display panel, the first conductor 11 and the second conductor 12, which both pass from one side of the support plate 1 to the other, are placed here at the same edge 5 of the panel.

However, this solution has a serious drawback: the discharge regions 9 located near this edge 5 are subjected to an impedance very different from that of the discharge regions 10 located near the opposite edge 6 of the panel; the difference corresponds to the impedance of the portions of electrodes 7, 8 lying between these regions 9, 10.

Because of this impedance difference, the operation of the cells of the panel differs over the entire length of the electrodes 7, 8 and the light characteristics of the discharge regions differ greatly from one edge 5 of the panel to the other edge 6, thereby seriously impairing the quality of the image display.

The object of the invention is to remedy simultaneously all the drawbacks of the solution shown in FIGS. 1 and 2 and that shown in FIG. 3.

For this purpose, the subject of the invention is an image display device comprising:

a metal support plate supporting, on its front face, a plasma discharge panel and, on its rear face, means for supplying the said panel and for driving the discharges thereof;

the said plasma panel itself comprising a front tile and a rear tile leaving between them plasma discharge regions and, between these tiles, at least a first array of electrodes serving in particular for sustaining discharges by applying voltage pulses between adjacent electrodes of two different series of electrodes of this first array, in which the connection ends of the electrodes of one series emerge on an opposite edge of the panel to that on which the connection ends of the electrodes of the other series emerge, characterized in that the connection ends of one of the series of electrodes emerging on one edge of the panel are connected to supply and drive means via transverse electrical conductors which are inserted between the said rear tile and the said metal plate and which extend, from the said ends, as far as the opposite edge of the panel.

The array of electrodes located between the tiles is generally placed on the internal face of one of the tiles, generally the front tile; the electrodes are generally covered with a dielectric layer; instead of being placed on the internal face, at least one of the series of electrodes may be placed between the tiles in the thickness of barrier ribs defining the discharge regions of the panel.

According to one embodiment, several electrodes of the same series are connected to the supply and drive means via the same transverse conductor.

The supply circuit for each pair of adjacent electrodes of two different series forms a current loop from the supply and drive means, passing through a first electrode, and then the second electrode of the pair; by virtue of the invention, the current loop of the supply circuit for each pair of the panel does not surround the metal plate, unlike the solutions described in the documents JP 2000-089723 and JP 11-041545; the Eddy current losses in the metal plate are thus limited, while obtaining discharge regions having identical impedances between the adjacent electrodes over their entire length; the losses are thus limited without degrading the image display quality.

Since according to the invention the transverse conductors are inserted between the rear tile of the panel and the support plate, it is no longer necessary for them to be shifted away from the light emission region, as in the abovementioned document EP 1 065 694, thereby allowing them to be positioned so as to advantageously limit the vertical cross section of the current loops of the various pairs of electrodes and the drawbacks associated therewith.

By virtue of the transverse conductors, the entire supply for the electrodes is brought back to the same edge of the panel so that it is then possible, as described in the invention JP 2000-089723 as shown in FIG. 3 appended hereto, to connect all the electrodes of the said array on the same edge of the panel to the supply and drive means; the advantage of this arrangement is that only a single electrical supply may serve, without any drawback, for all the alternations of the sustain pulses.

These transverse conductors are preferably grouped together in several ribbons of conductors, each located at a position corresponding approximately to the mean position of the electrodes to which the conductors of this ribbon are connected; since these electrodes generally correspond to lines of the panel, this position generally corresponds to a height on the panel; in the case of the use of three ribbons, the first would, for example, be positioned at ⅙ of the height of the panel, the second, for example, at mid-height and the third, for example, at ⅚ of the height.

In the case of the transverse conductors being grouped together in several ribbons thus separated from one another, the transverse return conductor for the return of the supply current from a pair of electrodes is therefore in general not located at the same height as this pair of electrodes but slightly offset with respect to this pair, and the corresponding current loop also has a vertical cross section of large area and generates an electromagnetic field having a large horizontal component; to avoid this drawback, each transverse conductor connected to a single electrode corresponding to one pair of adjacent electrodes is preferably positioned on the panel at approximately the same height as the said pair;

preferably, these transverse electrical conductors then form a single conducting ribbon inserted between the rear tile and the metal plate.

Preferably, this conducting ribbon or these conducting ribbons also serve as a means for fastening the panel to the said metal support plate; for this purpose, it will be possible to use, for example, one or more ribbons having both faces adhesive; the thickness of the conducting ribbon advantageously allows the differences in thermal expansion between the rear tile of the panel and the metal support plate to be reduced.

According to an advantageous embodiment of the invention, since the supply circuit for each pair has, at the start of the supply and drive means, a pair of supply conductors, each of which is connected to an electrode of the pair, the device according to the invention includes common-mode filtering means surrounding each pair of conductors.

The common-mode filter is designed in a manner known per se to reduce the transmission of the high-frequency electromagnetic interference coming from the electronic supply and drive means and transmitted in a common mode to the plasma panel.

Preferably, these common-mode filtering means comprise a tube made of a ferromagnetic material surrounding this pair of supply conductors.

During operation of the panel, at the position of this core, the currents flowing in each conductor of the same pair are opposed, thereby allowing this ferromagnetic tube to act as a common-mode filter and making it possible to reduce the transmission of high-frequency electromagnetic interference coming from the electronic supply and drive means and transmitted to the plasma panel.

Preferably, these said common-mode filtering means are implanted at the edge of the panel on which all the supply conductors for the electrodes emerge.

Since the opposite ends of the transverse electrical conductors from the ends for connection to the electrodes of the same series emerge at the same edge of the panel as the connection ends for the electrodes of the other series, it is very easy at this point to implant the filtering means since the supply conductors for each pair of electrodes are located there, near each other, and can be easily surrounded by a common-mode ferromagnetic filter tube.

In general, the plasma panel also includes a second array of electrodes for addressing the discharges, these intersecting the electrodes of the first array at the panel discharge regions.

The invention will be more clearly understood from the description that follows, given by way of non-limiting example, and with reference to the appended figures in which:

FIG. 1, already described, shows an overall sectional top view of an image display device;

FIGS. 2A and 2B, already described, show schematically the components and the electrical connections of a device according to the prior art with, in the upper part, a front view of a pair of sustain electrodes on the tile of a plasma panel and, in the lower part, a sectional view of the support plate of the panel and of the supply and drive means for the electrodes;

FIGS. 3A and 3B, already described, show, in the same way as in FIGS. 2A and 2B, another connection scheme as described in the document JP 2000-089723; and FIG. 4 illustrates a connection scheme according to a preferred embodiment of the invention, in which the entire display device is shown in cross section, except for the front tile which is shown in perspective so as to reveal the two sustain electrodes of the same pair.

To simplify the description and bring out the differences and advantages afforded by the invention compared with the prior art, identical references will be used for the elements that provide the same functions.

Apart from the elements already described with regard to the front tile 3 and rear tile 4 of the plasma panel, the metal support plate 1 and, at the back of this plate, an electrical supply 13' serving for supplying and driving the discharges in the panel, FIG. 4 shows:

- the front tile 3 is provided with an array of pairs of coplanar sustain electrodes 7, 8, one of the electrodes of each pair also serving for addressing;
- the rear tile 4 is provided with an array of address electrodes 18;
- since the connection ends of the electrodes 7 of a pair 7, 8 are, as in the prior art, located on an edge 5 of the panel and are connected to the supply 13' via the connection means 11, the connection ends of the other electrode 8 of this pair 7, 8 are located on the opposite edge 6 of the panel; and
- the connection end of this electrode 8 emerging on the edge 6 of the panel is connected to the supply 13' via conventional means 12 for connecting the ends of the electrodes and a transverse electrical conductor 21' placed between the front face of the metal plate 1 and the external face of the rear tile 4; this conductor 21' extends from one edge 6 of the panel to the other edge 5.

Thus, for each pair of adjacent electrodes 7, 8, the current loop of the supply circuit for this pair does not surround the metal plate 1.

The device illustrated in FIG. 4 also includes common-mode filtering means 15 surrounding each pair of conductors supplying a pair of electrodes 7, 8, in this case a tube of a ferromagnetic material implanted at the edge 5 of the panel, at the point where all the supply conductors for the electrodes emerge, namely the end 22 of the transverse conductor 21' for supplying the electrode 8 and the means 11 for connection to the electrode 7.

FIG. 4 shows that the current produced by the supply 13' leaves from one of its two terminals, travels through the connection means 11 to the end of the electrode 7, then passes through the panel between the electrodes 7 and 8 of the same pair before emerging at the other edge 6 of the panel via the means 12 for connecting to the end of the electrode 8 and returns to the other terminal of the generator 13' via the transverse connector 21', thus constituting a current loop; implementing the invention in this particular embodiment results in particular in:

- the current being prevented from flowing around the metal support plate 1 of the panel and thus limiting the electrical supply losses of the electrodes; and
- an identical operation being maintained for all the cells of the panel over the entire width of the panel between the opposed edges 5 and 6 of the panel.

Preferably, it will be endeavoured to minimize the internal area of the supply current flow loop of the panel for the purpose of reducing as far as possible the electromagnetic radiation induced by this loop; for this purpose, it is preferable to position each transverse conductor 21' connected to an electrode 8 corresponding to a pair of adjacent electrodes 7, 8 approximately at the same height as the said pair.

The invention claimed is:

1. Image display device comprising:

a metal support plate supporting, on its front face, a plasma discharge panel and, on its rear face, means for supplying the said panel and for driving the discharges thereof;

the said plasma panel itself comprising a front tile and a rear tile leaving between them plasma discharge regions and, between these tiles, at least a first array of electrodes serving in particular for sustaining discharges by applying voltage pulses between adjacent electrodes of two different series of electrodes of this first array, in which the connection ends of the electrodes of one series emerge on an opposite edge of the panel to that on which the connection ends of the electrodes of the other series emerge, wherein the connection ends of one of the series of electrodes emerging on one edge of the panel are connected to supply and drive means via transverse electrical conductors which are inserted between the said rear tile and the said metal plate and which extend, from the said ends, as far as the opposite edge of the panel.

2. Device according to claim 1, wherein these transverse conductors are grouped together in several ribbons of conductors, each located at a position corresponding approximately to the mean position of the electrodes to which the conductors of this ribbon are connected.

3. Device according to claim 1, wherein each transverse conductor is connected to a single electrode corresponding to one pair of adjacent electrodes and is positioned on the said panel at approximately the same height as the said pair.

4. Device according to claim 3, wherein these transverse electrical conductors form a single conducting ribbon inserted between the rear tile and the metal plate.

5. Device according to claim 2, wherein the said conducting ribbons or the said conducting ribbon also serve as a means for fastening the said panel to the said metal support plate.

6. Device according to claim 1, wherein since the supply circuit for each pair has, at the start of the supply and drive means, a pair of supply conductors, each of which is connected to an electrode of the pair, the said device includes common-mode filtering means surrounding each pair of conductors.

7. Device according to claim 6, wherein the common-mode filtering means comprise a tube made of a ferromagnetic material surrounding the said pair of supply conductors.

8. Device according to claim 6, wherein the said common-mode filtering means are implanted at the edge of the panel on which all the supply conductors for the electrodes emerge.

9. Device according to claim 1, wherein the said panel also includes a second array of electrodes for addressing the discharges, these intersecting the electrodes of the first array at the said discharge regions.

* * * * *